US005120628A

United States Patent [19]

Mammino et al.

[11] Patent Number: 5,120,62

[45] Date of Patent: Jun. 9, 199

[54] TRANSPARENT PHOTORECEPTOR OVERCOATINGS

[75] Inventors: Joseph Mammino, Penfield; Ronald F. Ziolo, Webster; Donald S. Sypula, Penfield, all of N.Y.

[73] Assignee: Xerox Corporation, Stamford, Conn.

[21] Appl. No.: 448,855

[22] Filed: Dec. 12, 1989

[51] Int. Cl.[5] ..... G03G 5/047

[52] U.S. Cl. ..... 430/59; 430/58; 430/66

[58] Field of Search ..... 430/58, 59, 66, 900

[56] References Cited

U.S. PATENT DOCUMENTS

| | | | |
|---|---|---|---|
| 3,121,006 | 2/1964 | Middleton et al. . | |
| 3,357,989 | 12/1967 | Byrne et al. . | |
| 3,442,781 | 5/1969 | Weinberger . | |
| 3,505,131 | 4/1970 | Wells . | |
| 3,677,816 | 7/1972 | Hayashi et al. . | |
| 3,837,851 | 9/1974 | Shattuck et al. . | |
| 3,895,944 | 7/1975 | Wiedemann et al. . | |
| 4,133,933 | 1/1979 | Sekine et al. | 428/328 |
| 4,150,987 | 4/1979 | Anderson et al. | 430/59 |
| 4,382,118 | 5/1983 | Oka | 430/66 X |
| 4,409,309 | 11/1983 | Oka | 430/66 |
| 4,515,882 | 5/1985 | Mammino et al. | 430/5 |
| 4,618,551 | 10/1986 | Stolka et al. | 430/5 |
| 4,675,262 | 6/1987 | Tanaka | 430/5 |
| 4,758,488 | 7/1988 | Johnson et al. | 430/5 |
| 4,772,525 | 9/1988 | Badesha et al. | 430/5 |
| 4,774,159 | 9/1988 | Stolka et al. | 430/5 |
| 4,806,443 | 2/1989 | Yanus et al. | 430/5 |
| 4,806,444 | 2/1989 | Yanus et al. | 430/5 |
| 4,818,650 | 4/1989 | Limburg et al. | 430/5 |

FOREIGN PATENT DOCUMENTS

| | | | |
|---|---|---|---|
| 59-159 | 1/1984 | Japan | 430/6 |

*Primary Examiner*—Roland Martin
*Attorney, Agent, or Firm*—Oliff & Berridge

[57] ABSTRACT

Highly transparent charge injection enabling species fc electrophotographic overcoatings include copper ( compounds dispersed throughout the overcoating c complexed into a charge transport matrix. The ove coatings contain an insulating, film forming continuo phase having charge transport molecules and the co per (I) compounds.

21 Claims, 1 Drawing Sheet

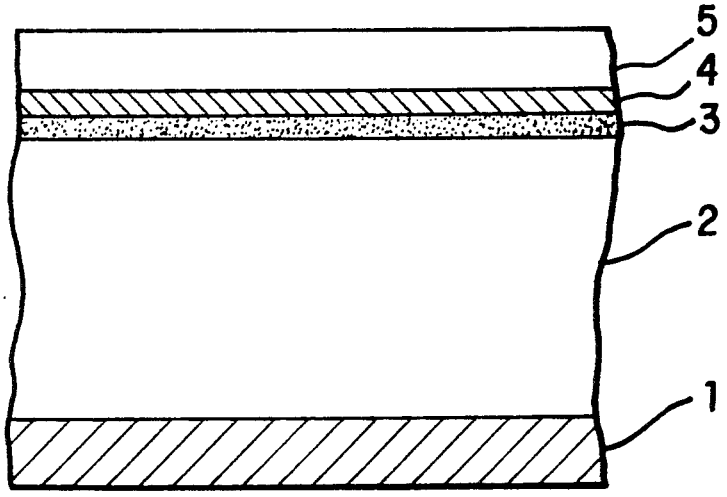
5
4
3
2
1

TRANSPARENT PHOTORECEPTOR OVERCOATINGS

BACKGROUND OF THE INVENTION

This invention relates to electrophotography, and more particularly, to an improved overcoated electrophotographic imaging member and method of making the electrophotographic imaging member.

Generally, electrophotographic imaging processes involve the formation and development of electrostatic latent images on the imaging surface of a photoconductive member. The photoconductive member is usually imaged by uniformly electrostatically charging the imaging surface in the dark, and exposing the member to a pattern of activating electromagnetic radiation, such as light, which selectively dissipates the charge in the illuminated areas of the member to form an electrostatic latent image on the imaging surface. The electrostatic latent image is then developed with a developer composition containing toner particles which are attracted to the photoconductive member in image configuration. The resulting toner image may be transferred to a suitable receiving member such as paper.

The imaging surface of many photoconductive members is sensitive to wear, ambient fumes, scratches and deposits which adversely affect the electrophotographic properties of the imaging member. Overcoating layers have been proposed to overcome the disadvantageous characteristics of these photoreceptors. However, many of the overcoating layers adversely affect electrophotographic performance of the electrophotographic imaging member.

One type of insulating electrophotographic imaging member has at least one photoconductive layer and an overcoating layer comprising an insulating, film forming continuous phase comprising charge transport molecules and finely divided charge injection enabling particles dispersed in the continuous phase.

Overcoatings for photoreceptors have been disclosed in U.S. Pat. No. 4,515,882. These overcoatings comprise an insulating film forming continuous phase comprising charge transport molecules and finely divided charge injection enabling particles dispersed in the continuous phase. The imaging members have at least one photoconductive layer and the overcoating layer. Where desired, a barrier layer may be provided in the device interposed between the photoconductive layer and the overcoating layer. The devices disclosed in U.S. Pat. No. 4,515,882 can be employed in an electrophotographic imaging process in which the outer imaging surface of the overcoating layer is uniformly charged in the dark. A sufficient electric field is applied across the electrophotographic imaging member to polarize the charge injection enabling particles whereby the charge injection enabling particles inject charge carriers into the continuous phase of the overcoating layer. The charge carriers are transported to and trapped at the interface between the photoconductive layer and the overcoating layer, and opposite space charge in the overcoating layer is relaxed by charge emission from the charge injection enabling particles to the imaging surface. The overcoating layer is essentially electrically insulating prior to deposition of the uniform electrostatic charge on the imaging surface.

The mechanism by which charge passes through the overcoating to the photoreceptive surface in known devices is believed to involve the electric field, formed by corona charging of the electrophotographic devic instantly polarizing the charge injection enabling part cles or species. Charge, for example, in the form holes, is injected into the hole transport phase of th overcoating and is driven by the charging field to th interface between the overcoating and photoconduc tive layer. The charge is stopped at the interface by blocking layer or because there is no injection into th photoreceptor. The negative space charge in the bulk the overcoating is relaxed by a charge emission.

However, overcoatings such as those disclosed U.S. Pat. No. 4,515,882 suffer from the disadvantage high light absorption and scattering in the coating du to pigment loading and particle size. Inorganic charg injection enabling particles mentioned in that pate include carbon black, molybdenum disulfide, silicon, t oxide, antimony oxide, chromium dioxide, zinc dioxid titanium oxide, magnesium oxide, manganese dioxid aluminum oxides, colloidal silica, graphite, tin, alum num, nickel, steel, silver, gold, other metals and the oxides, sulfides, halides and other salt forms, etc. Suc charge injection enabling particles tend to reduce th photosensitivity of the photoreceptor. For example, o weight percent of carbon black pigment, which is th prime effective charge injection enabling species cu rently in use, reduces light transmission to the photose sitive layer by about 20%.

Electrophotographic devices have been propose which include layers that are electrically conductir and transparent. For example, U.S. Pat. No. 3,505,1 discloses a method of preparing a highly transpare cuprous iodide conductive film. U.S. Pat. No. 3,677,8 discloses a method of producing transparent and electr cally conducting coatings of copper iodide. These filn are used as an electrode or ground in multielectro electrostatic systems.

Copper iodide has also been used in electrophotogr phy in protective layers, as disclosed in Japanese Une amined Patent Application No. 59-159 (1984). Th disclosed protective layer comprises 10-60 weight pe cent Cu iodide based on binder resin.

Another use of copper iodide in electrophotograp is disclosed in U.S. Pat. No. 4,133,933. Cuprous iodide provided in an electrosensitive recording sheet, and whitened by adding an alkaline substance for increasir the resistance of the cuprous iodide and for increasir the contrast of the recorded mask.

In the above-described devices, copper iodide is u lized primarily to achieve high electrical conductivit There continues to be a need for improved layers electrophotographic imaging members which a highly transparent and which will protect the imagir member from wear, ambient fumes and the like.

SUMMARY OF THE INVENTION

In accordance with the present invention, there provided an electrophotographic imaging member ha ing at least one photoconductive layer and an overcoa ing layer comprising an insulating, film forming conti uous phase comprising charge transport molecules ar highly transparent charge injection enabling specie Copper (I) compounds such as cuprous iodide are u lized as the charge injection enabling species. Whe desired, a barrier layer may be interposed between th photoconductive layer and the overcoating layer.

BRIEF DESCRIPTION OF THE DRAWINGS

A more complete understanding of the present inven-on can be obtained by reference to the accompanying rawing which shows a cross-sectional view of a multi-ıyer photoreceptor of the invention.

DETAILED DESCRIPTION OF PREFERRED EMBODIMENTS

The electrophotographic imaging member of the resent invention comprises an overcoating layer, pref-rably adjacent a photoconductive layer. The overcoat-ıg layer comprises charge transport molecules and ighly transparent charge injection enabling particles in ı insulating film forming continuous phase. The over-oatings of the present invention may be used for nega-ve and positive photoreceptors and are of particular ıterest for positive charging layered photoreceptors 'here the photoconductive charge generation and in-:ction layer is on the top surface, less than about one ıicron thick and subject to wear which, in the absence f the present invention, would lead to short receptor fe.

Any suitable insulating film forming binder having a ery high dielectric strength and good electrically insu-ting properties may be used in the continuous charge ansporting phase of the overcoating of the present vention. The binder itself may be a charge transport-g material or a material capable of holding transport olecules in solid solution or as a molecular dispersion. solid solution is defined as a composition in which at ast one component is dissolved in another component ıd which exists as a homogeneous solid phase. A mo-cular dispersion is defined as a composition in which ırticles of at least one component are dispersed in ıother component, the dispersion of the particles being ı a molecular scale.

Typical film forming binder materials that are not ıarge transporting materials include thermoplastic and ıermosetting resins such as polycarbonates, polyesters, ›lyamides, polyurethanes, polystyrenes, polyaryleth-'s, polyarylsulfones, polybutadienes, polysulfones, ›lyethersulfones, polyethylenes, polypropylenes, ›lyimides, polymethylpentenes, polyphenylene sul-les, polyvinylacetate, polysiloxanes, polyacrylates, ›lyvinylacetals, polyamides, amino resins, phenylene ıide resins, terephthalic acid resins, epoxy resins, phe-›lic resins, polystyrene and acrylonitrile copolymers, ›lyvinylchloride, vinyl chloride and vinyl acetate ›polymers, acrylate copolymers, alkyd resins, cellu-sic film formers, poly(amide-imide), styrene-butadi-ıe copolymers, vinylidenechloride-vinylchloride co-›lymers, vinyl acetate-vinylidenechloride copolymers, yrene alkyd resins, fluorocarbon resins, and the like.

Typical film forming binder materials that have ıarge transport capabilities are substantially non-›sorbing in the spectral region of intended use, but are :tive in that they are capable of transporting charge ırriers injected by the charge injection enabling parti-es in an applied electric field. The charge transport nder may be a hole transport film forming polymer or ı electron transport film forming polymer. Charge ansporting film forming polymers are well known in e art and include those enumerated in U.S. Pat. No. 515,882. Other transport polymers include arylamine ›mpounds disclosed in U.S. Pat. Nos. 4,806,443, 806,444 and 4,818,650, as well as polysilylenes dis-closed in U.S. Pat. Nos. 4,618,551, 4,774,159, 4,772,525 and 4,758,488.

The film forming binder should have an electrical resistivity of at least about $10^{13}$ ohm-cm. It should be capable of forming a continuous film and be substantially transparent to activating radiation to which the underlying photoconductive layer is sensitive. In other words, the transmitted activating radiation should be capable of generating charge carriers, i.e. electron-hole pairs, in the underlying photoconductive layer or layers. A transparency range of between about 35 percent and about 100 percent can provide satisfactory results depending upon the specific photoreceptors utilized. A transparency of at least about 50 percent is preferred for greater speed with optimum speeds being achieved at a transparency of at least greater than 90 percent. Transparency is meant to refer to the property of permitting the passage of radiations in the spectral region at which the underlying photoconductive layer or layers are sensitive.

Any suitable charge transport molecule capable of acting as a film forming binder or which is soluble or dispersable on a molecular scale in a film forming binder may be utilized in the continuous phase of the overcoating of this invention. The charge transport molecules should be capable of transporting charge carriers injected by the charge injection enabling particles in an applied electric field. The charge transport molecules may be hole transport molecules or electron transport molecules. Where the charge transport molecule is capable of acting as a film forming binder as indicated above, it may be employed, if desired, to function as both an insulating binder for the charge injection enabling particles and as the continuous charge transporting phase without the necessity of incorporating a different charge transport molecule in solid solution or as a molecular dispersion therein.

Such charge transporting materials are well known in the art. Diamines, pyrazolines, substituted fluorenes, oxidiazoles, hydrazones, tri-substituted methanes, transparent organic non-polymeric transport materials, and the like, as disclosed in U.S. Pat. No. 4,515,882, are examples of well known charge transporting materials.

When the charge transport molecules are combined with an insulating film forming binder, the amount of charge transport molecule which is used may vary depending upon the particular charge transport material, its compatibility with (e.g. solubility in) the continuous insulating film forming binder phase of the overcoating layer, and the like. Satisfactory results have been obtained using the proportions normally used to form the charge transport medium of photoreceptors containing a charge transport component and a charge generating component.

When the overcoating layers are prepared with only insulating film forming binder and charge transport molecules in solid solution or molecular dispersion in the film forming binder, the overcoating layer remains insulating after charging until at least the image exposure step. However, when sufficient charge injection enabling particles are dispersed in an overcoating layer containing an insulating film forming continuous phase capable of transporting charge carriers, the overcoating layer acquires the capability of being an insulator until a sufficient electric field is applied to polarize the charge injection enabling particles. Then, the charge injection enabling particles inject charge carriers into the continuous phase of the overcoating layer. The charge carriers are transported to and trapped at the interface between the underlying photoconductive layer and the overcoating layer. Opposite space charge in the overcoating layer is relaxed by charge emission from the charge injection enabling particles to the outer imaging surface of the overcoating.

The charge injection enabling particles of the present invention are comprised of a copper (I) compound. Copper (I) compounds have desirable properties in electrophotographic applications; for example, copper (I) compounds have desirable electrical properties, which properties are useful in electrically conducting ground planes and other conductive elements of a photoreceptor. Copper (I) compounds which can be used in the invention include cuprous iodide, cuprous bromide and cuprous chloride. A preferred copper (I) compound is cuprous iodide.

Cuprous iodide is an electrical conductor in bulk and film form, and is colorless and therefore highly transparent in the visible region by virtue of the $d^{10}$ electronic configuration of the $Cu^+$ ion, the colorless $I^-$ ion and the lack of charge transfer bands in the visible region. The transparent properties of cuprous iodide are desirable in the present invention. High pigment loadings of CuI are possible with little or no light absorption to reduce the photosensitivity of the photoreceptor.

The charge injection properties of copper (I) compounds have not previously been studied in a polymer transport matrix. Furthermore, relative to other transparent conductors such as $Cd_2SnO_4$ or the tin oxides containing In or Sb, cuprous iodide is generally considered to be less environmentally hazardous.

Cuprous iodide can adsorb surface moisture, oxygen, iodine and other species that may be used to control the charge injecting properties of the material in the matrix. The presence or absence of moisture, for example, may be controlled by the method and length of time of drying. The presence or absence of iodine may also be controlled. For example, in the reaction for the formation of CuI $$2CuSO_4+4KI+2Na_2S_2O_3 \rightarrow 2CuI+2K_2SO_4+Na_2S_4O_6+2NaI,$$

the copper (II) iodide formed initially by the combination of copper (II) ion and iodide ion in aqueous solution decomposes almost immediately by a redox reaction to yield copper (I) iodide and free iodine. The amount of free iodine in the sample may be controlled or eliminated by varying the amount of thiosulfate. The absorption of iodine in the sample may be desirable since its absorption increases the conductivity of the copper (I) iodide.

Light also has an effect on the surface properties of CuI, although its sensitivity to light is much less than that of CuBr which is much less than that of CuCl. Exposure to light will increase the conductivity of copper (I) iodide. This convenient type of controlling surface properties is not known for other transparent conductors such as $SnO_2$, doped $SnO_2$ or $Cd_2SnO_4$ /.

Generally, the overcoating layer should contain at least about 0.1 percent by weight of the charge injection enabling particles based on the total weight of the overcoating layer. At lower concentrations, a noticeable residual charge tends to form, which can be compensated during development by applying an electric bias as is known in the art. The upper limit for the amount of the charge injection enabling particles to be used depends upon the relative quantity of charge flow desired through the overcoating layer, but should be less th that which would reduce the transparency of the ove coating to a value less than about 35 percent and whi would render the overcoating too conductive.

The amount of charge injection enabling particl which can be loaded in the overcoating layer of t present invention may range from about 1 to about weight percent based on the total weight of the ove coating layer. The particular loading of charge inje tion enabling particles will depend on the desired pe cent transmission, desired conductivity, the bindi capability of the resin, the desired mechanical prope ties of the imaging member, e.g., flexibility, and t residual voltage on the photoreceptor. With copper compounds such as cuprous iodide, the loading may from about 1 to about 25 weight percent based weight of the total weight of the overcoating layer. particularly preferred loading of copper iodide is 3 to weight percent and most preferably about 10 to weight percent. With such loadings, transparent laye having a resistivity greater than about $10^{11}$ ohms-cm c be obtained.

The particle size of the charge injection enabli particles should be less than about 25 microns, prefe bly less than about 1 micron, and for molecular dispe sions less than the wavelength of light utilized to expo the underlying photoconductive layers. In other wor the particle size should be sufficient to maintain t overcoating layer substantially transparent to the wav length of light to which the underlying photocondu tive layer or layers are sensitive. A particle size betwe about 100 Angstroms and about 500 Angstroms h been found most suitable for light sources having wavelength greater than about 4,000 Angstroms. T particle size of the charge injection enabling particles the present invention may be controlled by the prepa tive route used to make the copper (I) compounds a their dispersions.

In addition to the advantages already mentione cuprous iodide and other copper (I) compounds ha the added advantage that they can form donor-accept complexes, for example, with amines or ammonia interaction between the nitrogen lone-pair of electro and the Cu(I) ion. Thus, the potential exists for we complexes to form in solution between CuI and mater comprising the charge transport layer for additional transparent overcoatings.

For example, a charge transport layer may compri a charge transport compound having the general fo mula:

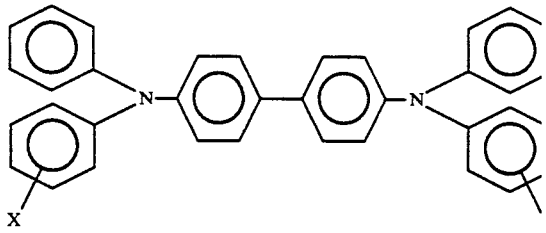

wherein X is selected from the group consisting of alkyl group, having from 1 to about 4 carbon atoms, a chlorine. This particular compound will hereinafter referred to as TAA. Weak complexes can form in sol tion between CuI and TAA. A surface of adsorb TAA on CuI in the matrix may also be envisioned, establishing an intimate electronic contact between the injecting and transport species. Transparency may be increased if the charge transporting molecules promote wetting of the matrix to CuI which will reduce voids at the interface to enhance the index of refraction gradient across the interface.

Other charge transport matrix materials which may be molecularly complexed with CuI include phosphine derivatives of TAA and polysilylenes disclosed in U.S. Pat. Nos. 4,618,551, 4,774,159, 4,772,525 and 4,758,488.

The components of the overcoating layer may be mixed together by conventional means. Typical mixing means include stirring rods, ultrasonic vibrators, magnetic stirrers, paint shakers, sand mills, roll pebble mills, sonic mixers, melt mixing devices and the like. It is important, however, that if the insulating film forming binder is a different material than the charge transport molecules, the charge transport molecules must either dissolve in the insulating film forming binder or be capable of being molecularly dispersed in the insulating film forming binder. A solvent or solvent mixture for the film forming binder and charge transport molecules may be utilized if desired. Preferably, the solvent or solvent mixture should dissolve both the insulating film forming binder and the charge transport molecules. The solvent selected should not adversely affect the underlying photoreceptor. For example, the solvent selected should not dissolve or crystallize the underlying photoreceptor.

The overcoating mixture may be applied to the photoconductive member or to a blocking layer, if a blocking layer is utilized. The overcoating mixture may be applied by known techniques. Typical coating techniques include all spraying techniques, draw bar coating, dip coating, gravure coating, silk screening, air knife coating, reverse roll coating, extrusion techniques and the like. Conventional drying or curing techniques may be utilized to dry the overcoating. The drying or curing conditions should be selected to avoid damaging the underlying photoreceptor. For example, the overcoating drying temperatures should not cause crystallization of amorphous selenium when an amorphous selenium photoreceptor is used.

The thickness of the overcoating layer after drying or curing may be preferably between about 1 micron and about 15 microns. Generally, overcoating thicknesses less than about 1 micron fail to provide sufficient protection for the underlying photoreceptor. Greater protection is provided by an overcoating thickness of at least about 3 microns. Resolution of the final toner image begins to degrade when the overcoating thickness exceeds about 15 microns. Clearer image resolution is obtained with an overcoating thickness less than about 8 microns. Thus, an overcoating thickness of between 3 microns and about 8 microns is preferred for optimum protection and image resolution.

The final dried or cured overcoating should be substantially insulating prior to charging. Satisfactory results may be achieved when the final overcoating has a resistivity of at least about $10^{11}$ ohm-cm, preferably $10^{13}$ ohm-cm, at fields low enough essentially to eliminate injection from the charge injection enabling particles into the transport molecule. The overcoating is substantially electrically insulating in the dark. The charge injection enabling particles will therefore not polarize in less than about $10^{-12}$ second and inject charge carriers into the continuous charge transporting phase in less than about 10 microseconds when an applied electric field less than about 5 volts per micron is applied across the imaging member from the conductive substrate to the outer surface of the overcoating.

The final dried or cured overcoating of the present invention is substantially non-absorbing in the spectral region at which the underlying photoconductive layer or layers are sensitive. The expression "substantially non-absorbing" is defined as a transparency of between about 35 percent and about 90 percent in the spectral region at which the underlying photoconductive layer or layers are sensitive. A transparency of at least about 50 percent in the spectral region at which the underlying photoconductive layer or layers are sensitive is preferred for a balance of electrical and optical properties in the coating speed with optimum speeds being achieved at a transparency of at least greater than 90 percent.

The overcoatings of the present invention may also reduce emission of toxic Se, Te and As particles generated from alloy photoreceptors of xerographic machines used in making copies. They may also inhibit crystallization of Se/Te alloys by chemical exposure to, e.g., mercury vapor in dental offices. Further, the overcoatings prevent extraction of charge transport molecules from layered photoreceptors in use with liquid developers.

Any suitable electrophotoconductive member may be overcoated with the overcoating layer of this invention. Generally, an electrophotoconductive member comprises one or more photoconductive layers on a supporting substrate.

The substrate may be opaque or substantially transparent and may comprise numerous suitable materials having the required mechanical properties. Accordingly, this substrate may comprise a layer of a non-conductive or conductive material such as an inorganic or an organic composition. If the substrate comprises non-conductive material, it is usually coated with a conductive composition. As insulating non-conducting materials there may be employed various resins known for this purpose including polyesters, polycarbonates, polyamides, polyurethanes, and the like. The insulating or conductive substrate may be flexible or rigid and may have any number of many different configurations such as, for example, a plate, a cylindrical drum, a scroll, an endless flexible belt, and the like. Preferably, the insulating substrate is in the form of an endless flexible belt and is comprised of a commercially available polyethylene terephthalate polyester known as Mylar available from E. I. du Pont de Nemours & Co.

The thickness of the substrate layer depends on numerous factors, including economical considerations, and thus this layer may be of substantial thickness, for example, over 200 microns, or of minimum thickness less than 50 microns, provided there are no adverse affects on the final photoconductive device. In one embodiment, the thickness of this layer ranges from about 65 microns to about 150 microns, and preferably from about 75 microns to about 125 microns.

A conductive layer or ground plane which may comprise the entire support or be present as a coating on a non-conductive layer may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member.

Accordingly, the conductive layer can generally range in thickness of from about 50 Angstroms to many centimeters. When a flexible photoresponsive imaging device is desired, the thickness may be between about 100 Angstroms to about 750 Angstroms, and more preferably from about 100 Angstroms to about 200 Angstroms.

Any suitable photoconductive layer or layers may be overcoated with the overcoating layer of this invention. The photoconductive layer or layers may be inorganic or organic. Typical inorganic photoconductive materials include well known materials such as amorphous selenium, selenium alloys, halogen-doped selenium alloys such as selenium-tellurium, selenium-tellurium-arsenic, selenium-arsenic, and the like, cadmium sulfoselenide, cadmium selenide, cadmium sulfide, zinc oxide, titanium dioxide and the like. Typical organic photoconductors include phthalocyanines, quinacridones, pyrazolones, polyvinylcarbazole-2,4,7-trinitrofluorenone, anthracene and the like. Many organic photoconductors may be used as particles dispersed in a resin binder.

Any suitable multilayer photoconductors may also be employed with the overcoating layer of this invention. The multilayer photoconductors comprise at least two electrically operative layers, a photogenerating or charge generating layer and a charge transport layer. Examples of photogenerating layers include trigonal selenium, various phthalocyanine pigments such as the X-form of metal free phthalocyanine described in U.S. Pat. No. 3,357,989, metal phthalocyanines such as copper phthalocyanine, quinacridones available from Du Pont under the tradename Monastral Red, Monastral violet and Monastral Red Y, substituted 2,4-diaminotriazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange. Examples of photosensitive members having at least two electrically operative layers include the charge generating layer and diamine containing transport layer members disclosed in U.S. Pat. No. 4,254,990; dyestuff generator layer and oxadiazole, pyrazalone, imidazole, bromopyrene, nitrofluorene and nitronaphthalimide derivative containing charge transport layer members disclosed in U.S. Pat. No. 3,895,944; generator layer and hydrazone containing charge transport layer members disclosed in U.S. Pat. No. 4,150,987; generator layer and a tri-aryl pyrazoline compound containing charge transport layer members disclosed in U.S. Pat. No. 3,837,851; and the like.

A preferred multilayered photoconductor comprises a charge generating layer comprising a layer of photoconductive material and a contiguous charge transport layer of a polycarbonate resin material having a molecular weight of from about 20,000 to about 120,000 having dispersed therein from about 25 to about 75 percent by weight of one or more compounds having the genera formula:

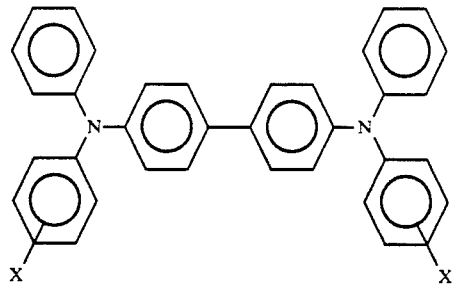

wherein X is selected from the group consisting of a alkyl group having from 1 to about 4 carbon atoms an chlorine. The photoconductive layer exhibits the capa bility of photogeneration of holes and injection of th holes. The charge transport layer is substantially non absorbing in the spectral region at which the photocon ductive layer generates and injects photogenerate holes from the photoconductive layer and transport the holes through the charge transport layer. Othe examples of charge transport layers capable of support ing the injection of photogenerated holes of a charg generating layer and transporting the holes through th charge transport layer include triphenylmethane, bis(4 diethylamine-2-methylphenyl) phenylmethane; 4'-4" bis(diethylamino)-2',2"-dimethyltriphenyl methane an the like dispersed in an inactive resin binder.

Numerous inactive resin materials may be employe in the charge transport layer including those described for example, in U.S. Pat. No. 3,121,006. The resinou binder for the charge transport layer may be identical t the resinous binder material employed in the charg generating layer. Typical organic resinous binders in clude thermoplastic and thermosetting resins such a polycarbonates, polyesters, polyamides, polyurethanes polystyrenes, polyarylethers, polyarylsulfones, polybu tadienes, polysulfones polyethersulfones, polyethyl enes, polypropylenes, polyimides, polymethylpentenes polyphenylene sulfides, polyvinyl acetate, polysilox anes, polyacrylates, polyvinyl acetals, amino resins phenylene oxide resins, terephthalic acid resins, epox resins, phenolic resins, polystyrene and acrylonitril copolymers, polyvinylchloride, vinylchloride and viny acetate copolymers, acrylate copolymers, alkyd resins cellulosic film formers, poly(amide-imide), styrene butadiene copolymers, vinylidenechloride-vinylchlo ride copolymers, vinylacetate-vinylidenechloride co polymers, styrenealkyd resins, and the like. These poly mers may be block, random or alternating copolymers Excellent results may be achieved with a resinou binder material comprising a poly(hydroxyether) mate rial selected from the group consisting of those of th following formulas:

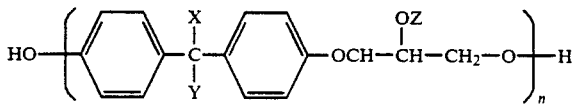

I.

and

-continued

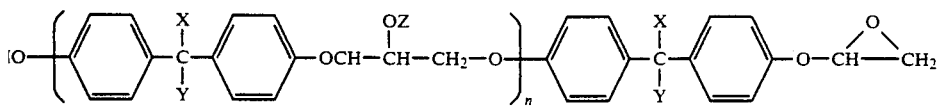

II.

/herein X and Y are independently selected from the roup consisting of aliphatic groups and aromatic roups, Z is hydrogen, an aliphatic group or an aroıatic group, and n is a number of from about 50 to bout 200.

These poly(hydroxyethers), some of which are comıercially available from Union Carbide Corporation, re generally described in the literature as phenoxy esins or epoxy resins.

Examples of aliphatic groups for the poly(hydroxethers) include those containing from about 1 carbon tom to about 30 carbon atoms, such as methyl, ethyl, ropyl, butyl, pentyl, hexyl, heptyl, decyl, pentadecyl, icodecyl, and the like. Preferred aliphatic groups inlude alkyl groups containing from about 1 carbon atom ɔ about 5 carbon atoms, such as methyl, ethyl, propyl, nd butyl. Illustrative examples of aromatic groups ıclude those containing from about 6 carbon atoms to bout 25 carbon atoms, such as phenyl, naphthyl, anthyl, and the like, with phenyl being preferred. The alihatic and aromatic groups can be substituted with arious known substitutents, including, for example, lkyl, halogen, nitro, sulfo and the like.

Examples of the Z substituent include hydrogen as /ell as aliphatic aromatic, substituted aliphatic and ıbstituted aromatic groups as defined herein. Furtherıore Z can be selected from carboxyl, carbonate, and ther similar groups, resulting in for example, the correɔonding esters, and carbonates of the poly(hydroxethers).

Preferred poly(hydroxyethers) include those wherein : and Y are alkyl groups, such as methyl, Z is hydrogen r a carbonate group, an n is a number ranging from bout 75 to about 100. Specific preferred poly(hydroxethers) include Bakelite, phenoxy resins PKHH, comıercially available from Union Carbide Corporation nd resulting from the reaction of 2,2-bis(4-hydroxyhenylpropane), or bisphenol A, with epichlorohydrin, n epoxy resin, Araldite R 6097, commercially available ·om CIBA, the phenylcarbonate of the poly(hydroxethers) wherein Z is a carbonate grouping, which ıaterial is commercially available from Allied Chemial Corporation, as well as poly(hydroxyethers) derived ·om dichloro bisphenol A, tetrachloro bisphenol A, ɜtrabromo bisphenol A, bisphenol F, bisphenol ACP, isphenol L, bisphenol V, bisphenol S, and the like.

The photogenerating layer containing photoconducve compositions and/or pigments and the resinous inder material generally ranges in thickness from about .1 micron to about 5.0 microns, and preferably has a ıickness of from 0.3 micron to about 1 micron. Thickesses outside these ranges can be selected providing ıe objectives of the present invention are achieved.

The photogenerating composition or pigment is presnt in the poly(hydroxyethers) resinous binder composion in various amounts. Generally from about 10 perent by volume to about 60 percent by volume of the hotogenerating pigment is dispersed in about 40 perent by volume to about 90 percent by volume of the oly(hydroxyether) binder. Preferably from about 20 ercent by volume to about 30 percent by volume of the hotogenerating pigment is dispersed in about 70 percent by volume to about 80 percent by volume of the poly(hydroxyether) binder composition. In one embodiment about 25 percent by volume of the photogenerating pigment is dispersed in about 75 percent by volume of the polyhydroxyether binder composition.

Other typical photoconductive layers include amorphous or alloys of selenium such as selenium-arsenic, selenium-tellurium-arsenic, selenium-tellurium, selenium-arsenic-antimony, halogen doped selenium alloys, cadmium sulfide and the like.

Generally, the thickness of the transport layer is between about 5 to about 100 microns, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1, and in some instances as great as 400:1.

The following are examples of overcoatings prepared with an insulating film forming binder polymer, Merlon M-50F polycarbonate, available from Mobay Chemical Company, an active hole transporting material TAA and a charge injecting enabling particulate material cuprous iodide. The examples are intended to be illustrative only. The invention is not intended to be limited to the materials, conditions, process parameters and the like recited herein.

Comparative Example 1

The solution which was used for the spray application of the overcoating consisted of 16.3 gms of Merlon M-50F, 11.2 gms of TAA (40 percent weight), 660 gms of methylene chloride and 440 gms of 1,1,2 trichloroethane. This solution did not contain the charge injection enabling particles. It was applied by spray coating to a brush grained aluminum plate and clear Mylar film. The coating was applied with a conventional automatic spray gun Model 21 manufactured by the Binks Manufacturing Co. of Franklin Park, Ill. The coating was dried at 110° C. for 30 minutes and had a measured thickness of 4 microns. The visible light transmittance of the overcoating as measured on the clear Mylar substrate was 99.9 percent. The overcoating on the aluminum plate was evaluated for charge injection by corona charging with a potential of +5000 and −5000 volts applied to the corotron wire. The charge on the surface of the overcoating was measured with a conventional electrostatic voltmeter. The charge and measure cycle was repeated several times to determine the stability of the charge on the surface of the overcoating. The results of these charge and measure cycles are as follows.

| Cycle | Corotron Voltage | |
|---|---|---|
| | +5000 volts | −5000 volts |

-continued

| Cycle | | |
|---|---|---|
| | Surface Potential | |
| 1 | +56 volts | −248 volts |
| 2 | +136 volts | −264 volts |
| 3 | +168 | −280 volts |

EXAMPLE II

The procedure described in Example I was repeated except that the solution for the spray application of the overcoating consisted of 16.3 gms of Merlon M-50F, 11.2 gms of TAA (40 percent weight), 0.275 gms of cuprous iodide (1 percent weight), 660 gms of methylene chloride and 440 gms of 1,1,2 trichloroethane. The visible light transmittance of the overcoating was 99.9 percent. The results of the charge and measure cycles are as follows.

| Cycle | | |
|---|---|---|
| | Corotron Voltage | |
| | +5000 volts | −5000 volts |
| | Surface Potential | |
| 1 | +50 volts | −18 volts |
| 2 | +80 volts | −20 volts |
| 3 | +88 | −24 volts |

EXAMPLE III

The procedure described in Example I was repeated except that the solution for the spray application of the overcoating consisted of 16.3 gms of Merlon M-50F, 11.2 gms of TAA (40 percent weight), 1.375 gms of cuprous iodide (5 percent weight), 660 gms of methylene chloride and 440 gms of 1,1,2 trichloroethane. The visible light transmittance of the overcoating was 97.7 percent. The results of the charge and measure cycles are as follows.

| Cycle | | |
|---|---|---|
| | Corotron Voltage | |
| | +5000 volts | −5000 volts |
| | Surface Potential | |
| 1 | +24 volts | −6 volts |
| 2 | +32 volts | −8 volts |
| 3 | +32 volts | −8 volts |

EXAMPLE IV

The procedure described in Example I was repeated except that the solution for the spray application of the overcoating consisted of 16.3 gms of Merlon M-50F, 11.2 gms of TAA (40 percent weight), 2.75 of cuprous iodide (10 percent weight), gms of methylene chloride and 440 gms of 1,1,2 trichloroethane. The visible light transmittance of the overcoating was 93.0 percent. The results of the charge and measure cycles are as follows.

| Cycle | | |
|---|---|---|
| | Corotron Voltage | |
| | +5000 volts | −5000 volts |
| | Surface Potential | |
| 1 | +8 volts | −2 volts |
| 2 | +14 volts | −2 volts |

-continued

| Cycle | | |
|---|---|---|
| 3 | +16 volts | −4 volts |

EXAMPLE V

The procedure described in Example I was repeate except that the solution for the spray application of tl overcoating consisted of 16.3 gms of Merlon M-50l 11.2 gms of TAA (40 percent weight), 4.125 gms ( cuprous iodide (15 percent weight), 660 gms of meth; lene chloride and 440 gms of 1,1,2 trichloroethane. Tl visible light transmittance of the overcoating was 91 percent. The results of the charge and measure cycl are as follows.

| Cycle | | |
|---|---|---|
| | Corotron Voltage | |
| | +5000 volts | −5000 volts |
| | Surface Potential | |
| 1 | +8 volts | −2 volts |
| 2 | +16 volts | −2 volts |
| 3 | +16 volts | −4 volts |

These results indicate that, without the charge inje tion enabling particles, the 4 microns thick insulatir film forming binder and charge transport molecu layer charges to an unacceptable high voltage leve This level is reduced as larger amounts of the char injection enabling particles are introduced into the ins lating film forming binder and charge transport mol cules. This indicates that cuprous iodide is an effecti charge injection enabling particulate material that i jects charge carriers into the continuous phase of tl overcoating layer. The charge carriers are transporte through the overcoating layer and to the conducti substrate where they combine with the opposite pola ity charge. Opposite space charge in the overcoatir layer is relaxed by charge emission from the char injection enabling particles to the outer imaging surfa of the overcoating.

EXAMPLE VI

The solutions prepared as described in Examples I III, IV and V were spray coated onto organic photor ceptors which had a ground plane 1, a charge transpo layer 2 and a charge generating layer 3. An electric charge blocking layer 4 was applied to the organ photoreceptor of the Figure prior to the application the overcoating 5 to trap the charge carriers which a produced by the overcoating during the application the electric charge field to the overcoated photorece tor. The electrical charge blocking layer consisted about 1.0 micron of a one to one weight ratio of zirc nium acetylacetonate in Butvar B-72 from the Mo santo Polymers and Petrochemicals Co. of St. Loui Mo. The coating was applied using the spray coatir equipment described in Example I. The coating w dried at 110° C. for 30 minutes. The overcoating w applied to the organic photoreceptor with the electric charge blocking layer by use of the spray coating equi ment described in Example I. A photoreceptor with tl electrical charge blocking layer was spray coated wi each of the overcoatings of Examples II, III, IV and for print testing and another was half coated for electr al cycling measurements. The overcoated photoreceptors were dried at 110° C. for 30 minutes.

The electrical measurements were made in a cycling scanner at a rotational rate for the photoreceptor of 24 revolutions per minute. The charging was done at a constant current of 3.6 microamperes and a Xerox 4045 machine erase lamp was used to discharge the photoreceptor before recharging. The voltage on the photoreceptor was measured at 0.20 and 1.12 seconds after charging and after exposure to the erase lamp. The difference between the voltage measured at 0.20 and 1.12 seconds after charging divided by the difference in the measurement time corresponds to the dark decay of the voltage on the photoreceptor. The photoreceptors which were overcoated with the overcoating materials that had less than 5 percent weight of cuprous iodide showed a wide circumferential variation in the initial voltage measured at 0.20 seconds after charging. The initial, residual and dark decay voltages decreased with increasing loading of the cuprous iodide in the overcoating. The largest changes occurred for loadings of from 0 to 5 weight percent of cuprous iodide in the overcoating. The initial voltage decreased from 1200 volts to 740 volts indicating that the overcoating was effective in enabling injection and the charge was trapped at the interface of the photoreceptor.

The initial voltage on the photoreceptor was the same for the overcoated and unovercoated sides when the overcoating contained 15 weight percent of cuprous iodide. Cycling of the photoreceptor resulted in a significant increase in the dark decay to 100 volts for the unovercoated side as it degraded under the action of the corona from the charging corotron. There was no significant change in the initial voltage and dark decay for the overcoated side of the photoreceptor. The residual voltage on the overcoated side of the photoreceptor increased to 75 volts after 200 cycles while that on the unovercoated side stabilized at 16 volts. The overcoating that contained 15 weight percent of cuprous iodide had the lowest residual voltage and best cycling characteristics.

Print tests illustrated that the photoreceptor with the overcoating that contained 15 weight percent of cuprous iodide gave good quality toner developed line copy as compared to the unovercoated photoreceptor. No blurring of the developed image was observed although there was a slight graininess to the toner developed image area. There was no difference in the background quality for the overcoated versus the unovercoated photoreceptor. Continuous toner developed imaging of the overcoated photoreceptor was done and 500 prints were obtained. The unovercoated photoreceptor failed after 2000 prints.

While the present invention has been described in detail with particular reference to preferred embodiments thereof, it will be understood that variations and modifications can be effected within the spirit and scope of the invention as described herein above and as defined in the appended claims.

What is claimed is:

1. An electrophotographic imaging member, comprising a substantially transparent layer comprising charge transport molecules and 3 to 25weight percent based on the total weight of said transparent layer charge injection enabling species of a copper (I) compound, wherein said layer is prepared from a molecular dispersion of said copper (I) compound in a film forming continuous phase.

2. The electrophotographic imaging member according to claim 1, wherein said copper (I) compound is cuprous halide.

3. The electrophotographic imaging member according to claim 1, wherein said copper (I) compound is cuprous iodide.

4. The electrophotographic imaging member according to claim 1, wherein said charge injection enabling species are particles.

5. The electrophotographic imaging member of claim 1, wherein said film forming continuous phase is insulating.

6. The electrophotographic imaging member of claim 1, wherein said transparent layer is an insulating overcoating layer.

7. The electrophotographic imaging member of claim 1, wherein said transparent layer has a transparency of at least about 35%.

8. The electrophotographic imaging member of claim 1, wherein said transparent layer has a transparency greater than about 90%.

9. The electrophotographic imaging member of claim 1, wherein said transparent layer comprises about 10 to about 20 weight percent of said charge injection enabling species based on weight of said transparent layer.

10. The electrophotographic imaging member of claim 1, wherein said transparent layer comprises about 10 to about 20 weight percent of cuprous iodide based on weight of said transparent layer.

11. The electrophotographic imaging member of claim 1, wherein said transparent layer has a resistivity greater than about $10^{11}$ ohm-cm.

12. The electrophotographic imaging member of claim 1, wherein said charge injection enabling species are molecularly complexed with said charge transport molecules.

13. An electrophotographic imaging member, comprising at least one photoconductive layer and an overcoating layer comprising a film forming continuous phase comprising charge transport molecules and 3 to 25 weight percent based on the total weight of said transparent layer charge injection enabling species of a copper (I) halide compound, wherein said overcoating layer is prepared from a molecular dispersion of said copper (I) halide compound in said continuous phase.

14. The electrophotographic imaging member of claim 13, wherein said copper (I) halide compound is cuprous iodide.

15. The electrophotographic imaging member of claim 13, wherein said film forming continuous phase is insulating.

16. The electrophotographic imaging member of claim 13, wherein said charge transport molecules comprise at least one compound having the formula:

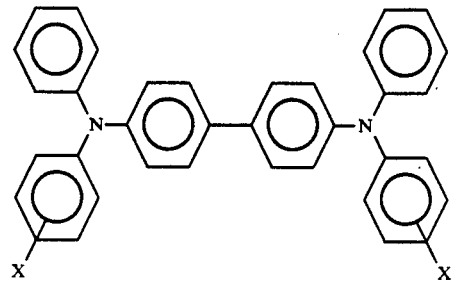

wherein X is selected from the group consisting of an alkyl group having from 1 to about 4 carbon atoms and chlorine.

17. The electrophotographic imaging member of claim 13, wherein said charge transport molecules are molecularly complexed with said copper (I) halide compound.

18. The elctrophotographic imaging member of claim 13, wherein said overcoating layer has a transparency of at least about 35%.

19. The electrophotographic imaging member claim 13, wherein said overcoating layer has a transpa ency of at least about 90%.

20. The electrophotographic imaging member claim 13, wherein said overcoating layer compris about 10 to about 20 percent of cuprous iodide based ( weight of said transparent layer.

21. The electrophotographic imaging member claim 13, wherein said overcoating layer has a resisti ity greater than about $10^{11}$ ohm-cm.

* * * * *